US008917070B2

(12) United States Patent
El-Nozahi et al.

(10) Patent No.: US 8,917,070 B2
(45) Date of Patent: Dec. 23, 2014

(54) LDO AND LOAD SWITCH SUPPORTING A WIDE RANGE OF LOAD CAPACITANCE

(71) Applicant: Vidatronic, Inc., College Station, TX (US)

(72) Inventors: Mohamed Ahmed Mohamed El-Nozahi, Heliopolis (EG); Mohamed Mostafa Saber Aboudina, College Station, TX (US); Sameh Assem Ibrahim, Cairo (EG); Faisal Abdellatif Elseddeek Ali Hussien, College Station, TX (US); Moises Emanuel Robinson, Austin, TX (US)

(73) Assignee: Vidatronic, Inc., College Station, TX (US)

( * ) Notice: Subject to any disclaimer, the term of this patent is extended or adjusted under 35 U.S.C. 154(b) by 0 days.

(21) Appl. No.: 13/830,478

(22) Filed: Mar. 14, 2013

(65) Prior Publication Data

US 2014/0266104 A1 Sep. 18, 2014

(51) Int. Cl.
*G05F 1/565* (2006.01)
*G05F 1/575* (2006.01)

(52) U.S. Cl.
CPC ..... *G05F 1/575* (2013.01); *G05F 1/565* (2013.01)
USPC ..... 323/273

(58) Field of Classification Search
CPC ..... G05F 1/56; G05F 1/573; G05F 1/575
USPC ..... 323/273–275, 280, 281
See application file for complete search history.

(56) References Cited

U.S. PATENT DOCUMENTS

| | | | | |
|---|---|---|---|---|
| 6,300,749 | B1 * | 10/2001 | Castelli et al. | 323/273 |
| 6,603,292 | B1 * | 8/2003 | Schouten et al. | 323/274 |
| 6,700,361 | B2 * | 3/2004 | Gregorius | 323/274 |
| 7,521,909 | B2 * | 4/2009 | Dow et al. | 323/280 |
| 8,232,783 | B2 * | 7/2012 | Yanagawa | 323/280 |
| 2013/0069608 | A1 * | 3/2013 | Gakhar et al. | 323/273 |

* cited by examiner

*Primary Examiner* — Adolf Berhane
*Assistant Examiner* — Jye-June Lee
(74) *Attorney, Agent, or Firm* — Osha Liang LLP

(57) ABSTRACT

A method to maintain stability of a low drop-out (LDO)/load switch linear voltage regulator (LVR). The method includes determining, during a power-up phase and by a capacitance sensing circuit, an estimated output capacitance value at an output node of the LDO/load switch LVR, and adjusting, based on the estimated output capacitance value, an adaptive RC network in the LDO/load switch LVR, wherein the adaptive RC network produces an adaptive zero in a feedback network transfer function of the LDO/load switch LVR, wherein the adaptive zero reduces an effect of a non-dominant pole in the open loop transfer function of the LDO/load switch LVR, and wherein a frequency of the adaptive zero is inversely proportional to the estimated output capacitance value.

13 Claims, 9 Drawing Sheets

LDO AND LOAD SWITCH SUPPORTING A WIDE RANGE OF LOAD CAPACITANCE

BACKGROUND

FIG. 1 shows a schematic block diagram of an LDO (low-dropout) linear voltage regulator (100) with high power supply rejection (PSR). The LDO linear voltage regulator is commonly referred to as simply "LDO." As shown in FIG. 1, the feedback network (101), including a resistor divider and an error amplifier (102), regulates the DC output voltage $V_{out}$ to a desired level given by $V_{out}=V_{ref}*(1+R_1/R_2)$. The error amplifier (102) may be a single stage or a multi-stage amplifier. The resistor $R_1$ may be a short circuit, and the resistor $R_2$ may be an open circuit in some architectures. The pass transistor $M_{pass}$ may be either a field effect transistor (FET) or a bipolar transistor, and may be of either n-type or p-type. Multi-stage and high-gain amplifiers are typically used as the implementation of the error amplifier (102) in the feedback network (101). $C_{ext}$ (104) represents a physical off-chip external capacitor, and $C_L$ (105) represents the load capacitance (without including $C_{ext}$). The supply rejection block (103) is used to enhance the power supply rejection of the LDO (100). LDO architectures are generally categorized into two main categories: LDOs that requires an external capacitor and LDOs that do not require an external capacitor.

Architectures that require external capacitor to guarantee the stability of the LDO usually have superior performance over the other type. These performance parameters include both superior power supply rejection (PSR) and load transient regulation. Power supply rejection is the ability of the LDO to reject any noise coming from the supply through the $V_{in}$ terminal in FIG. 1. Throughout this disclosure, the terms, "power supply," "supply," "$V_{IN}$," and "$V_{IN}$ terminal" may be used interchangeably to refer to the power source input to a voltage regulator. Further, load transient regulation is the change in the output voltage $V_{out}$ when there is an instantaneous change in the load current, $I_L$. In prior art, LDOs that use external capacitor achieve PSR of around 56 dB at 10 MHz, and load transient regulation of less than 10 mV when the load current changes from 1 to 100 mA in 1 μsec (with an external capacitance higher than 1 μF). The external capacitor is usually any capacitor that cannot be implemented on the same chip where the LDO is implemented.

On the other hand, LDOs that do not require an external capacitor are referred to as capacitor-less LDOs. Generally, the capacitor-less LDOs use on-chip capacitors. The main advantage of the capacitor-less implementation is that it does not require an external capacitor. This helps to reduce the cost of any device that uses this LDO. Capacitor-less LDOs are used to supply power to multiple circuits inside Systems-On-a-Chip (SOCs) and microprocessors, including embedded memories, PLLs, DLLs and high-speed interfaces. The main drawback of this architecture is that both PSR and load transient regulation are much worse than LDOs using external capacitors. Prior art designs reported PSR worse than 50 dB at 1 MHz, and load transient regulation worse than 1V when the load current changes from 1 to 200 mA in 1 μsec. Increasing the load current makes these two parameters even worse. Prior art designs show that increasing the maximum current to 500 mA makes the PSR to be worse than 30 dB at 1 MHz. These two performance parameters show that the capacitor-less LDO cannot be used in many applications that require superior performance of PSR and load transient regulation.

FIG. 2 shows a schematic block diagram of a capacitor-less LDO (200) with high PSR (based on the supply rejection block (203)). As noted above, a capacitor-less LDO (200) has degraded performance comparing to the LDO (100) shown in FIG. 1. The reason for the degraded performance is that the capacitor-less LDO (200) requires that the dominant pole of the open loop transfer function be placed in the feedback network (201), e.g., via the second stage amplifier (204) with the miller capacitor $C_m$ shown in FIG. 2. This technique is widely applied in many capacitor-less LDO such as the work done by Dow et. al. (U.S. Pat. No. 7,512,909) and Castelli, et. al. (U.S. Pat. No. 6,300,749). Generally, the prior art implementations of capacitor-less LDOS place this dominant pole in the feedback loop. Placing the dominant pole in the feedback loop at the output of the error amplifier (202) makes the LDO (200) slower, and thus it does not react fast enough to the load transient variations and the input line variations. In addition, a zero that depends on the load current must be implemented to support a wide range of DC load currents. Possible implementations were shown by Castelli, et. al. (U.S. Pat. No. 6,300,749), and Gregorius (U.S. Pat. No. 6,700,361 B2). Another drawback of placing the dominant pole in the feedback loop is that this limits the performance of capacitor-less LDOs. For example, the best PSR and load transient regulation that capacitor-less LDOs can achieve, such as the capacitor-less LDO (200), are typically limited to about 40 dB at 1 MHz, and 1V for a step in the load current of 200 mA in 1 μsec, respectively. Another drawback of many existing capacitor-less LDOs is that they cannot support capacitor loads from 0 to 10 micro-Farad (μF). Prior art capacitor-less LDOs typically become unstable (e.g., the LDO output would oscillate) if the output capacitor exceeds 1 nano-Farad (nF). On the contrary, prior art LDOs that require external capacitor cannot be used when the load capacitance is lower than 0.1 μF (e.g., the LDO output would oscillate). Accordingly, there is a need for an LDO that can support a wide range of load capacitance values ranging from 0 to 10 μF and load resistances ranging from infinity to the maximum allowed current.

The load switch regulator has substantially the same structure as the LDO voltage regulator. The main difference between the LDO and the load switch regulator is the reference voltage ($V_{ref}$). In the case of LDO voltage regulator, $V_{ref}$ is supply independent and usually generated from a bandgap reference voltage circuit. In the case of the load switch regulator, $V_{ref}$ is a scaled (and filtered) version of the DC value of the supply. Thus, the DC level of the output voltage $V_{out}$ changes proportionally with the DC level of the input voltage V. Accordingly, the block diagrams shown in FIGS. 1 and 2 may also be used to represent a load switch regulator with external capacitor and a capacitor-less load switch regulator, respectively. Similar to the capacitor-less LDO voltage regulators, capacitor-less load switch regulators have a limited PSR and load transient regulation of about 50 dB at 1 MHz, and 1V for a step in the load current of 200 mA in 1 μsec, respectively. Throughout this disclosure, the terms "load switch regulator," "load switch linear voltage regulator," and "load switch" may be used interchangeably. Further, the term "LDO/load switch linear voltage regulator" refers to either an LDO or a load switch depending on specific configurations of the reference voltage used.

SUMMARY

In general, in one aspect, the invention relates to a method to maintain stability of a low drop-out (LDO)/load switch linear voltage regulator (LVR). The method includes determining, during a power-up phase and by a capacitance sensing circuit, an estimated output capacitance value at an output node of the LDO/load switch LVR, and adjusting, based on the estimated output capacitance value, an adaptive RC network in the LDO/load switch LVR, wherein the adaptive RC network produces an adaptive zero in a feedback network transfer function of the LDO/load switch LVR, wherein the adaptive zero reduces an effect of a non-dominant pole in the open loop transfer function of the LDO/load switch LVR, and wherein a frequency of the adaptive zero is inversely proportional to the estimated output capacitance value.

In general, in one aspect, the invention relates to a linear voltage regulator (LVR) circuit. The LVR circuit includes a (i) feedback network comprising a first input coupled to an output of the LVR circuit, a second input coupled to a reference voltage, a third input coupled to a capacitance sensing circuit block, and an output driving a gate terminal of a pass transistor, (ii) the capacitance sensing circuit block comprising an input coupled to the output of the LVR circuit, and an output coupled to the third input of the feedback network, and (iii) the pass transistor comprising the gate terminal driven by the output of the feedback network, a first terminal coupled to an input of the LVR circuit, and a second terminal coupled to the output of the LVR circuit.

In general, in one aspect, the invention relates to a low drop-out (LDO)/load switch linear voltage regulator (LVR) circuit, the LDO/load switch LVR circuit includes a MOS power device configured to generate a $V_{out}$ output from a $V_{in}$ input, and a feedback control circuit coupled to the MOS power device and configured to adjust a gate control signal supplied to the MOS power device for regulating a voltage level of the Vout output, wherein the gate control signal is adjusted based on a difference between a reference voltage signal and a sample of the voltage level of the Vout output, wherein the feedback network is configured to place a dominant pole at the Vout output without using an external capacitor.

In general, in one aspect, the invention relates to a low drop-out (LDO)/load switch linear voltage regulator (LVR) circuit, the LDO/load switch LVR circuit includes (i) a MOS power device configured to generate a $V_{out}$ output from a $V_{in}$ input, (ii) a feedback control circuit coupled to the MOS power device and configured to adjust a gate control signal supplied to the MOS power device for regulating a voltage level of the $V_{out}$ output, wherein the gate control signal is adjusted based on a difference between a reference voltage signal and a sample of the voltage level of the $V_{out}$ output, and (iii) a capacitance estimating circuit configured to estimate an output load capacitance at the $V_{out}$ output, wherein the feedback control circuit is adjusted based on the estimated output load capacitance.

Other aspects of the invention will be apparent from the following description and the appended claims.

BRIEF DESCRIPTION OF DRAWINGS

The appended drawings illustrate several embodiments of the invention and are not to be considered limiting of its scope, for the invention may admit to other equally effective embodiments.

DETAILED DESCRIPTION

Figure 1:
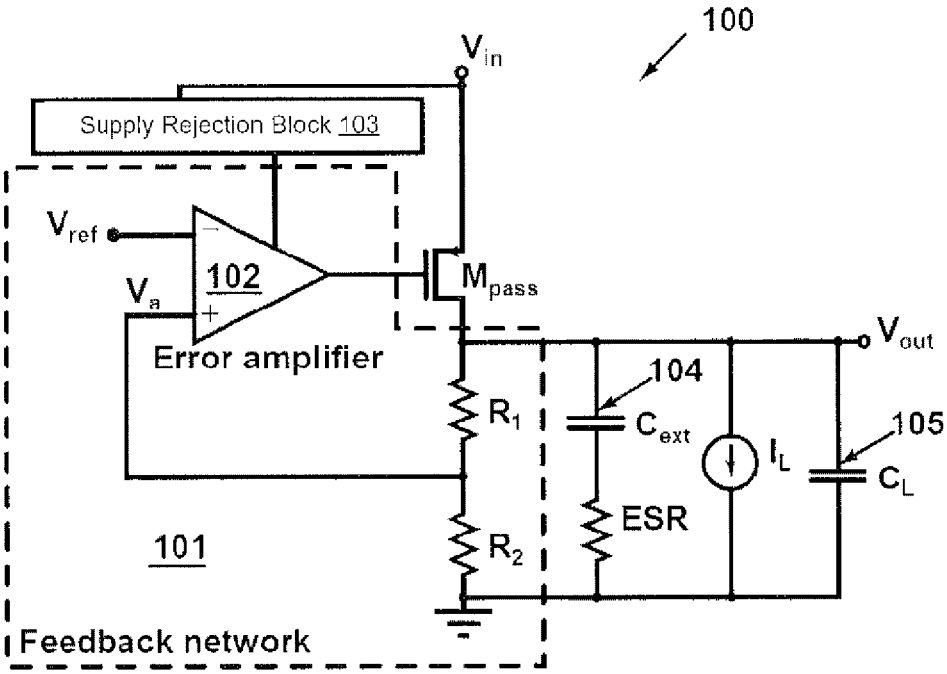
FIG. 1 (Prior Art)
FIG. 1 shows a schematic block-level circuit diagram of an LDO/load switch linear voltage regulator, in which embodiments of the invention may be implemented.

Aspects of the present disclosure are shown in the above-identified drawings and described below. In the description, like or identical reference numerals are used to identify common or similar elements. The drawings are not necessarily to scale and certain features may be shown exaggerated in scale or in schematic in the interest of clarity and conciseness.

Embodiments of the invention relate to a capacitor-less LDO and/or load switch linear voltage regulator with an improved architecture that is capable of driving a load capacitance ranging from 0 to 10 micro-Farads (μF) while achieving improved power supply rejection and load transient regulation. In one or more embodiments of the invention, the improved LDO/load switch architecture achieves PSR better than 45 dB at 10 MHz for load currents larger than 500 mA, and load transient regulation better than 60 mV for a step in the load current from 0 mA to 200 mA in 1 μsec without an external capacitor. Power supply rejection and load transient regulation are even better if an external capacitor is used. The following features of the invention will be described using the capacitor-less LDO as example, those skilled in the art, with the benefit of this disclosure will appreciate that same or similar features are equally applicable to the load switch as well.

In one or more embodiments, the LDO linear voltage regulator with the improved feedback network is implemented on a microchip, such as a semiconductor integrated circuit. As noted above, capacitor-less LDO voltage regulators do not require an external capacitor. In particular, many prior art capacitor-less LDOs fail to function properly with any external capacitor. In one or more embodiments, the improved capacitor-less LDO may function properly with or without an external capacitor. Throughout this disclosure, the terms "LDO," "LDO linear voltage regulator," "capacitor-less LDO," "improved capacitor-less LDO," and "LDO linear voltage regulator with the improved feedback network" may be used interchangeably depending on the context.

Figure 2:
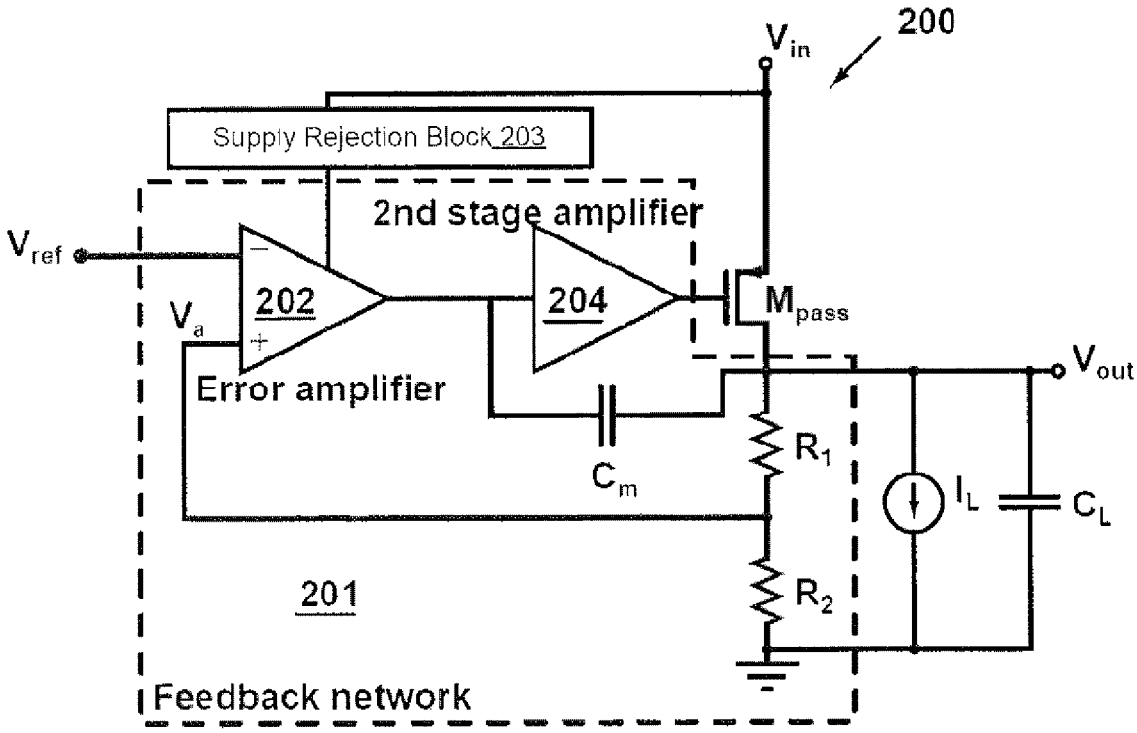
FIG. 2 (Prior Art)
FIG. 2 shows a schematic block-level circuit diagram of a typical prior art capacitor-less LDO/load switch linear voltage regulator.

In one or more embodiments, the improved capacitor-less LDO linear voltage regulator has a dominant pole at the LDO output node (i.e., the terminal) instead of placing the dominant pole in the feedback network. As noted above, the dominant pole of an example prior art capacitor-less LDO solution is placed at the output of the error amplifier (e.g., the error amplifier (202) depicted in FIG. 2 above). Placing the dominant pole at the LDO output node increases the speed of the feedback network such that the LDO reacts to load current variations and supply noise variations with improved response time. This leads to better PSR and transient load regulation. In one or more embodiments, placing the dominant pole at the LDO output node allows the use of an additional off-chip capacitor to achieve better performance parameters. For example, this approach may allow the use of an off-chip load capacitance anywhere from 0 to 10 μF. Typically, forcing the LDO output node to be the dominant pole in capacitor-less LDO solutions requires a large output capacitor that cannot be integrated on the same chip. Embodiments of the invention use a particular circuit configuration shown in FIG. 3 to overcome this issue.

Figure 3:
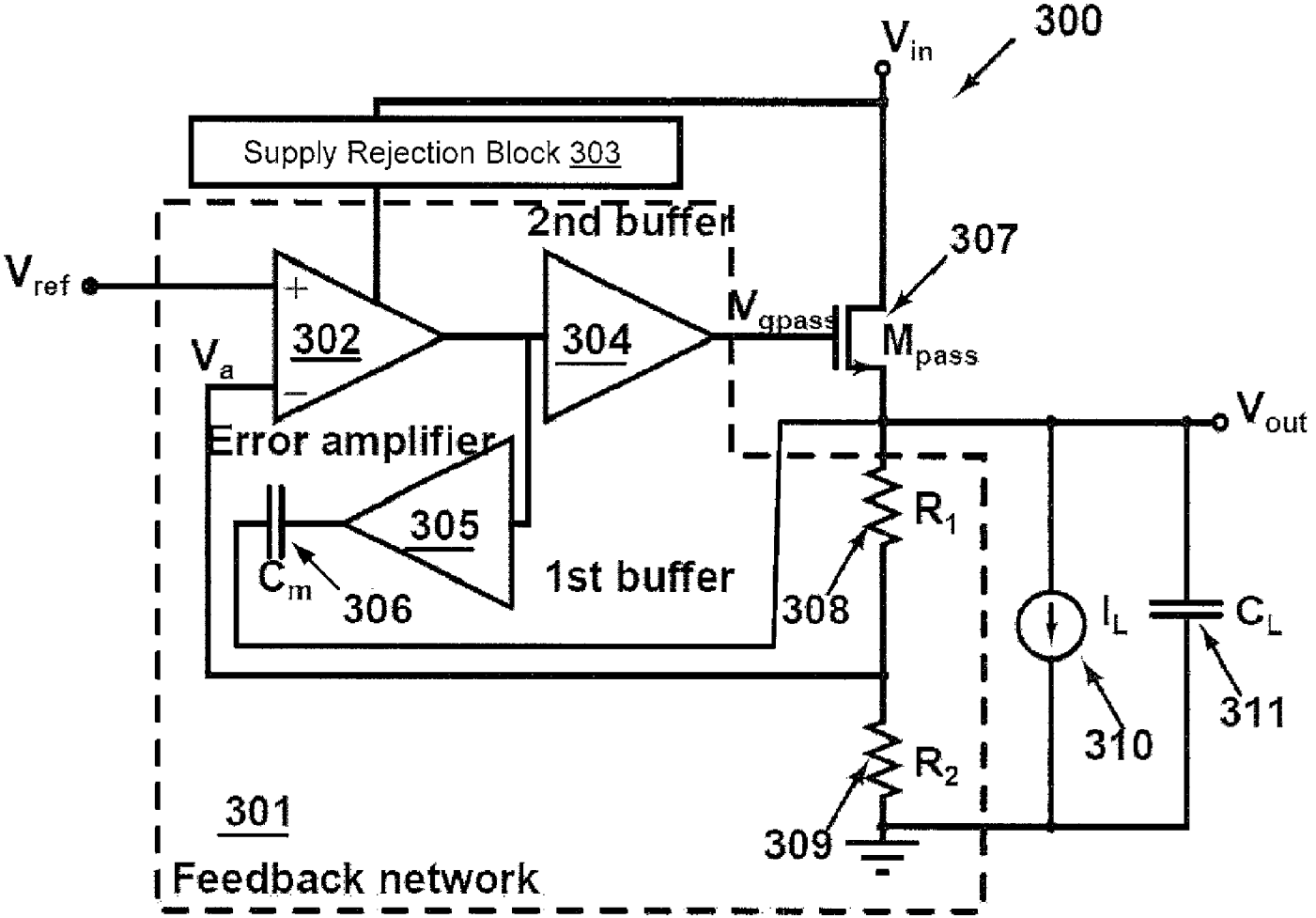
FIG. 3 shows a schematic block-level circuit diagram of a capacitor-less LDO/load switch linear voltage regulator in accordance with embodiments of the invention.

FIG. 3. shows a schematic block-level circuit diagram of an improved capacitor-less LDO (300) that includes a feedback network (301) (including an error amplifier (302) (e.g., a single or multi-stage amplifier), a capacitor $C_m$ (306), a second voltage buffer (304), a first voltage buffer (305), and a resistive divider network formed by a resistor (308) and a resistor (309)), a pass transistor device $M_{pass}$ (307), a supply rejection block (303), and a load capacitor $C_L$ (311). In addition, the current source $I_L$ (310) represents the load current of the improved capacitor-less LDO (300). In particular, the improved capacitor-less LDO (300) is essentially the same as the LDO (100) where the feedback network (101) is implemented using an improved feedback network described below to eliminate the need of the external capacitor $C_{ext}$ (104) shown in FIG. 1. Although the pass transistor device (307) is shown in FIG. 3 as an NMOS transistor, other types of the devices, such as PMOS transistor, NPN or PNP bipolar junction transistors may also be used. In one or more embodiments, the error amplifier (302) may be a single-stage amplifier or a multi-stage amplifier, and one or more of the second voltage buffer (304) and the first voltage buffer (305) may provide a gain or attenuation. In one or more embodiments of the invention, one or more of the modules and elements shown in FIG. 3 may be omitted, repeated, and/or substituted. Accordingly, embodiments of the invention should not be considered limited to the specific arrangements of modules shown in FIG. 3.

In one or more embodiments, forcing the dominant pole at the output of the improved capacitor-less LDO (300) is achieved by amplifying the value of the capacitor $C_m$ (306) with the gain of the error amplifier (302). Depending on the gain, the capacitor $C_m$ (306) may have an equivalent capacitance (referred to as the effective output capacitance) at the output node $V_{out}$ that is much higher than the value of $C_m$ (306). Specifically, the effective output capacitance is $C_m*A_e$, where $A_e$ is the gain of the error amplifier (302). For example, a 100 pico-Farad (pF) capacitor (i.e., $C_m$ (306)) across an amplifier (i.e., error amplifier (302)) with a gain of 10000 is equivalent to an effective load capacitance of 1 μF at the output node (i.e., $V_{out}$ terminal of the capacitor-less LDO (300)). The 1 μF is comparable to the external capacitors used for the LDOs that require an external capacitor to operate. Thus, the improved capacitor-less LDO (300) has an effective output capacitance that is similar to the LDO architectures requiring an external capacitor. Accordingly, the need for an external capacitor is eliminated in the improved capacitor-less LDO (300) and the cost of the overall system is reduced.

In one or more embodiments, the first voltage buffer (305) is used to isolate the output node of the error amplifier (302) such that it is not affected by the variations in the load current $I_L$ (310) to achieve better load transient regulation. Also, the first voltage buffer (305) introduces a zero to cancel one of the non-dominant poles. In one or more embodiments, the second voltage buffer (304) is used to drive the large parasitic capacitance introduced by the pass transistor device $M_{pass}$ (307). Although the second voltage buffer (304) and the first voltage buffer (305) are used to achieve better load transient regulation and PSR performances, in one or more embodiments, the second voltage buffer voltage buffer (304) and the first voltage buffer (305) are not required for forcing the dominant pole at the output of the capacitor-less LDO (300). In one or more embodiments, the improved capacitor-less LDO (300) supports load capacitances ranging from 0 to 10 nF.

Figure 4:
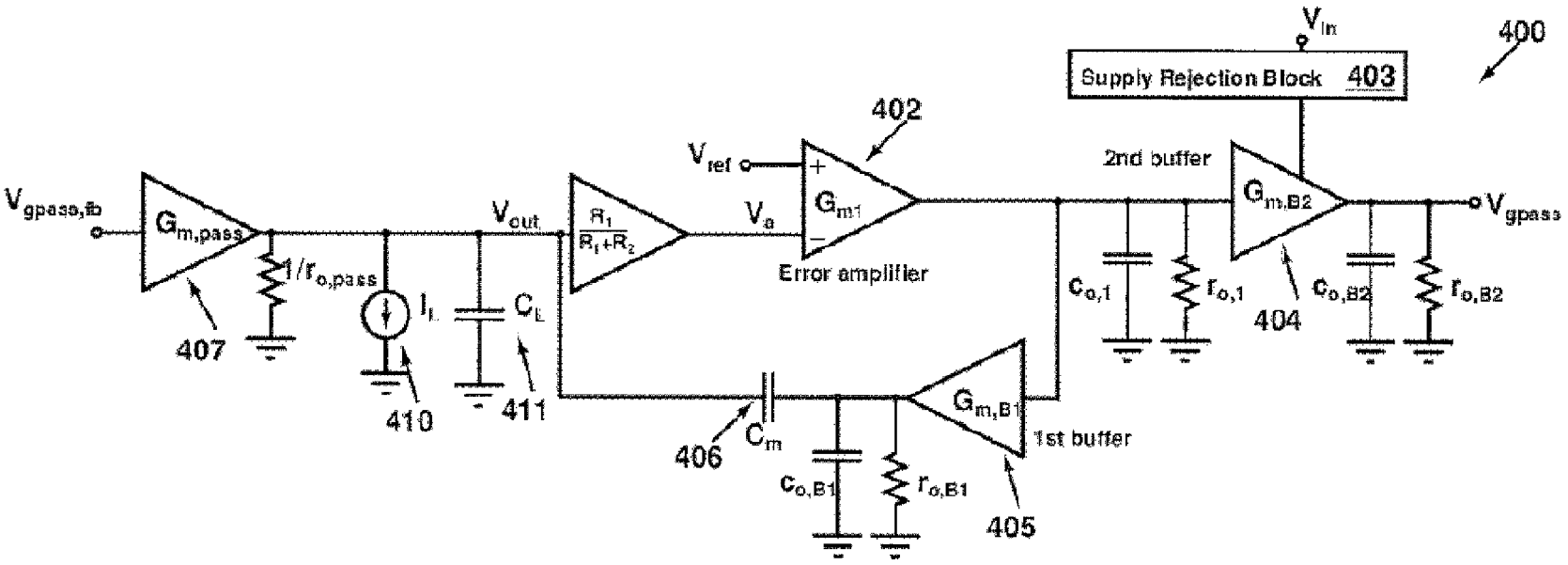
FIG. 4 shows a schematic block-level circuit diagram, in the open loop configuration, of a capacitor-less LDO/load switch linear voltage regulator in accordance with embodiments of the invention.

FIG. 4 shows a schematic block-level circuit diagram, in the open loop configuration, of an improved capacitor-less LDO linear voltage regulator (400). In one or more embodiments, the terminals $V_{gpass}$ and $V_{gpass,fb}$ of the LDO (400) are connected together to form the closed loop configuration similar to the LDO (100) shown in FIG. 1 or the improved capacitor-less LDO (300) shown in FIG. 3. Specifically, with the exception of being shown in the open loop configuration, the improved capacitor-less LDO (400) is essentially the same as the improved capacitor-less LDO (300) with output resistances/capacitances of various amplifier/buffer elements explicitly shown as circuit elements. In other words, as shown in FIG. 4, the error amplifier (402), the supply rejection block (403), the second voltage buffer (404), the first voltage buffer (405), the pass transistor device (407), the load current (410), and the load capacitor (411) are equivalent to the error amplifier (302), the supply rejection block (303), the second voltage buffer (304), the first voltage buffer (305), the pass transistor device (307), the load current (310), and the load capacitor (311), respectively, shown in FIG. 3. Further as shown in FIG. 4, the error amplifier (402), the first voltage buffer (405), and the second voltage buffer (404) are referred to as the transconductance amplifiers $G_{m1}$, $G_{m,B1}$, and $G_{m,B2}$, respectively. Further, $r_{o1}$, $r_{oB1}$, and $r_{o,B2}$ represent equivalent resistances at the output nodes of the transconductance amplifiers $G_{m1}$, $G_{m,B1}$, and $G_{m,B2}$, respectively. Further still, $c_{o1}$, $c_{o,B1}$, and $c_{o,B2}$ represent equivalent capacitances at the output nodes of the transconductance amplifiers $G_{m1}$, $G_{m,B1}$, and $G_{m,B2}$, respectively.

Mathematical analysis shows that the open loop transfer function from $V_{gpass,fb}$ to $V_{gpass}$ is given by $TF=(V_{gpass}/V_{gpass,fb})=A_o(1+S/\omega_{cz})/(1+\beta_1 s+\beta_2 s^2+\beta_3 s^3)=(1+s/\omega_{cz})/[(1+s/\omega_{p1})(1+s/\omega_{p2})(1+s/\omega_{p3})]$, where $A_0$ is the DC gain, $\omega_{cz}$ is a zero, $s=j\omega$, $\omega$ is the frequency in radians, and $\beta_1$, $\beta_2$, and $\beta_3$ are the coefficients responsible for the dominant and non-dominant poles, given by $\omega_{p1}$, $\omega_{p2}$, and $\omega_{p3}$, in the transfer function. $A_0$, $\omega_{cz}$, $\beta_1$, $\beta_2$, and $\beta_3$ are functions of the circuit element values in FIGS. 3 and 4. As is known to those skilled in the art, a pole or a zero of a transfer function (e.g., $V_{gpass}/V_{gpass,fb}$) refers to a frequency at which the transfer function becomes infinity or zero, respectively. The pole frequency is usually approximated by the product of total resistance to ground and total capacitance to ground at any circuit node. In this context, the pole is said to be placed at the circuit node. The main limitation is that the non-dominant pole, $\omega_{p3}$, introduced by coefficient $\beta_3$ starts to move lower in frequency as the value of the load capacitance $C_L$ (411) and load resistance denoted by $I_L$ (410) increase. Therefore, the stability of the improved capacitor-less LDO (400) at different load capacitance and resistance is affected. This happens because the coefficient $\beta_3$ is proportional to the load time constant composed of the product of capacitance $C_L$ (411) and load resistance denoted by $I_L$ (410). As the time constant increases in value, $\beta_3$ increases resulting in the non-dominant pole moving lower in frequency, and thus limiting the maximum value of the load capacitance $C_L$ (411) and load resistance. In one or more embodiments, the maximum value of the load capacitance $C_L$ (411) is limited to 10 nF and the load resistance is limited to 100 kΩ.

Figure 5A:
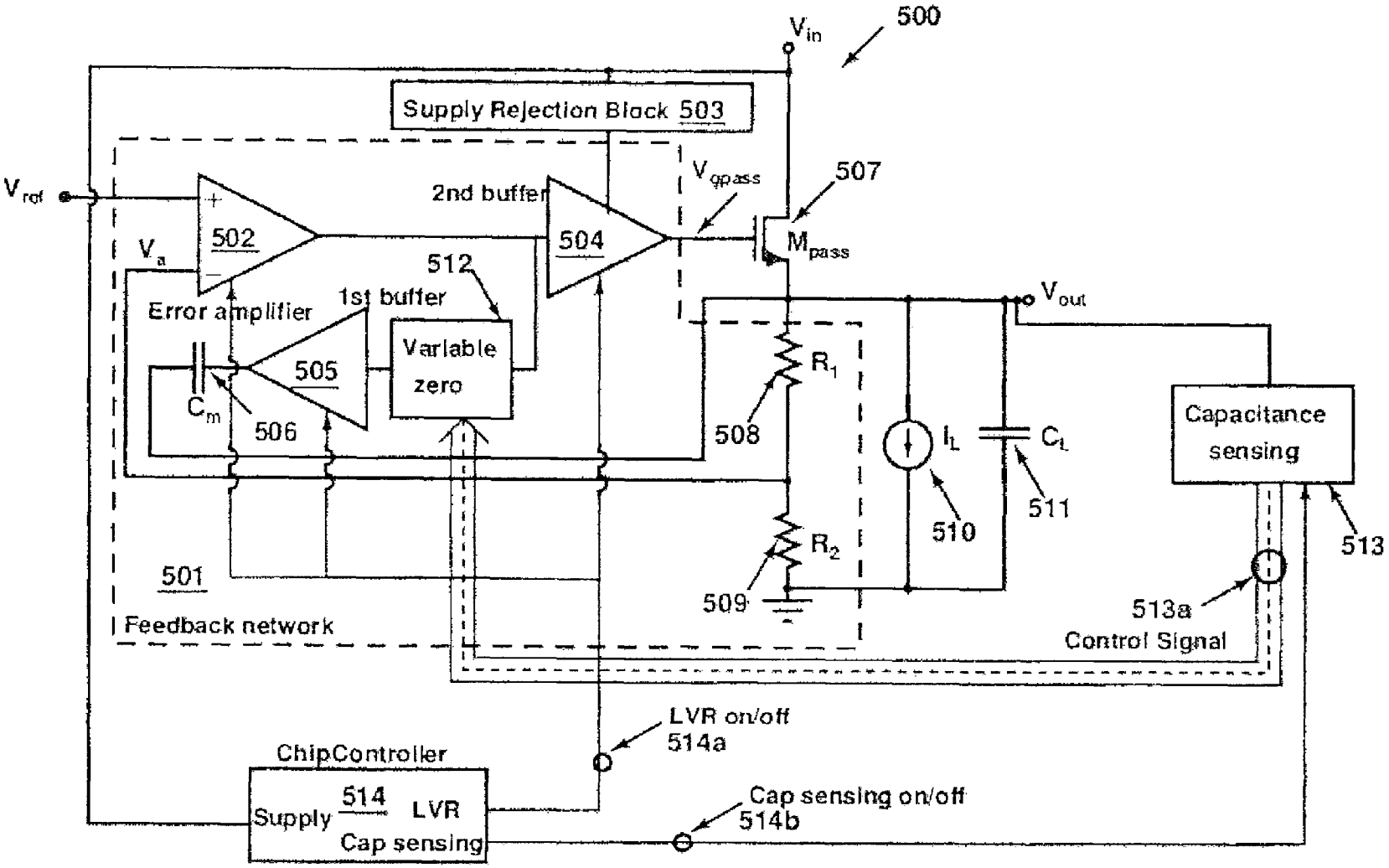
FIG. 5A shows a schematic block-level circuit diagram of a capacitor-less LDO/load switch linear voltage regulator with an additional load capacitance sensing circuitry in accordance with embodiments of the invention.
Figure 5B:
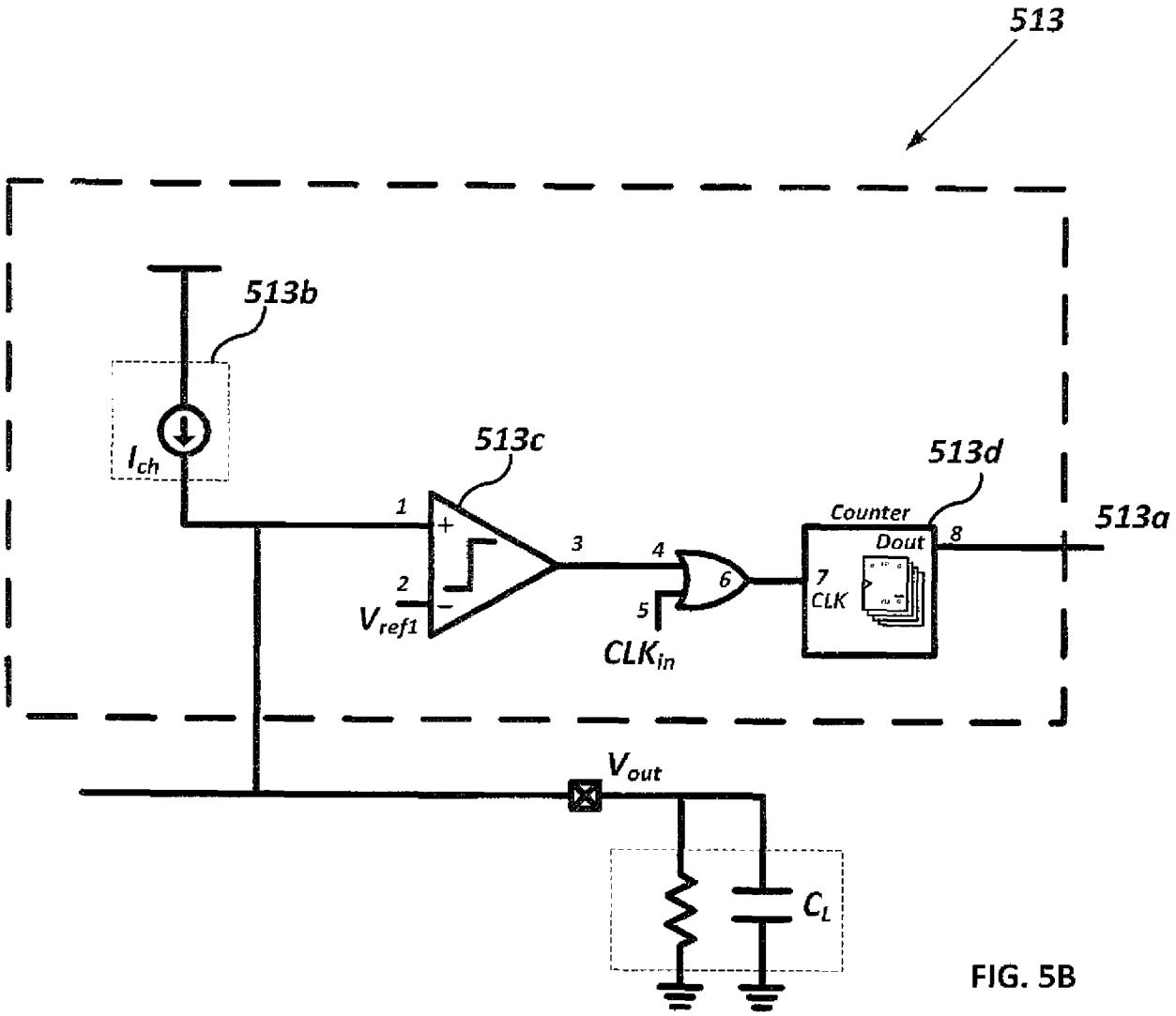
FIG. 5B shows a schematic block-level circuit diagram of a capacitance sensing circuit 513 in FIG. 5A. As shown, the capacitance sensing circuit 513 includes a current source 513*b*, a comparator 513*c*, and a counter 513*d*.

The aforementioned limitation is relieved using a load capacitance sensing scheme illustrated in FIG. 5 to adjust the internal parameters of the LDO. These circuit elements could be either on and/or off the same chip including the capacitor-less LDO. The capacitance sensing approach can be applied to the existing LDO architectures, and is not limited to the circuit invention shown in FIG. 3.

FIG. 5A shows an improved capacitor-less LDO linear voltage regulator (500) with an additional capacitance sensing circuitry to support a wide range of load capacitances from 0 to 10 μF and resistance from infinity down to maximum allowed current. In particular, the capacitance sensing circuitry includes three circuit blocks, namely the chip controller block (514), the capacitance sensing block (513), and the variable zero block (512). The remaining elements of the improved capacitor-less LDO (500) are essentially the same as corresponding elements shown in FIG. 3 above. Specifically, as shown in FIG. 5A, the error amplifier (502), the supply rejection block (503), the second voltage buffer (504), the first voltage buffer (505), the pass transistor device (507), the load current (510), and the load capacitor (511) are equivalent to the error amplifier (302), the supply rejection block (303), the second voltage buffer (304), the first voltage buffer (305), the pass transistor device (307), the load current (310), and the load capacitor (311), respectively, shown in FIG. 3 above. Further, the error amplifier (502), the second voltage buffer (504), and the first voltage buffer (505) can be turned off by a LVR on/off signal (514*a*). In one or more embodiments, the feedback network (501) is a combination of the feedback network (301) and the variable zero block (512). In one or more embodiments, the capacitance sensing block (513) is used to initially estimate the capacitance of the load capacitor (511) before the improved capacitor-less LDO (500) starts supplying the load current (510). In case that there is a short circuit load, the load detection circuit does not turn on the LVR, and thus it protects it from being damaged.

In one or more embodiments, the capacitance sensing block (513) includes a current source, a comparator, a counter, and a clock. Each clock cycle the counter increments its count by one. The current source initially starts to charge the off chip load capacitor $C_L$ (511). As a result, the output voltage $V_{out}$ starts to increase with time. At the same time, the counter is incrementing with time based on the clock. Once the output voltage $V_{out}$ reaches a pre-specified value, the counter stops counting at a final count. The final count is proportional to the load capacitor $C_L$ (511). In other words, a higher final count corresponds to a larger load capacitance value, and vice versa. Accordingly, the final count represents an estimate of the load capacitance of $C_L$ (511). During the load capacitance estimation phase, the pass transistor $M_{pass}$ (507) is switched off. Once the load capacitance value is estimated, a control signal (513*a*) is generated by the capacitance sensing block (513) to control the variable zero block (512). This control signal (513*a*) may be an analog signal or a digital signal (e.g., a digital word pattern). In response, the variable zero block (512) introduces a zero (referred to as an adaptive zero) in the transfer function ($V_{gpass}/V_{gpas,fb}$) to reduce or cancel the effect of the unwanted pole $\omega_{p3}$ having a changing value affected by variations of the load capacitor (511). The modified transfer function ($V_{gpass}/V_{gpas,fb}$) can be approximated by $TF \cong (1+s/\omega_{cz})(1+s/\omega_{cz2})/[(1+s/\omega_{p1})(1+s/\omega_{p2})(1+s/\omega_{p3})]$, where $\omega_{cz2}$ is the zero introduced by the variable zero block (512). In one or more embodiments, the variable zero block (512) includes a resistance-capacitance network, wherein the control signal (513*a*) changes the value of the resistance and/or the capacitance of the resistance-capacitance network. The variable zero block (512) may be a $1^{st}$ order low pass filter (LPF) based on a single resistance and capacitance. The input terminal of variable zero block (512) is the input of the LPF and the output terminal of the variable zero block (512) is the output of the LPF. The frequency of the adaptive zero may be adjusted by changing either the value of the resistance or the capacitor in the LPF. In one or more embodiments, the frequency of the adaptive zero is inversely proportional to the estimated output capacitance value and the adaptive zero is used to reduce phase margin degradation due to at least one non-dominant pole (e.g., $\omega_{p3}$) of the open loop transfer function of the LDO/load switch LVR. As a result, the LDO linear voltage regulator (500) remains stable over a number of capacitive load conditions ranging from no capacitive load to a 10 μF load.

Figure 6:
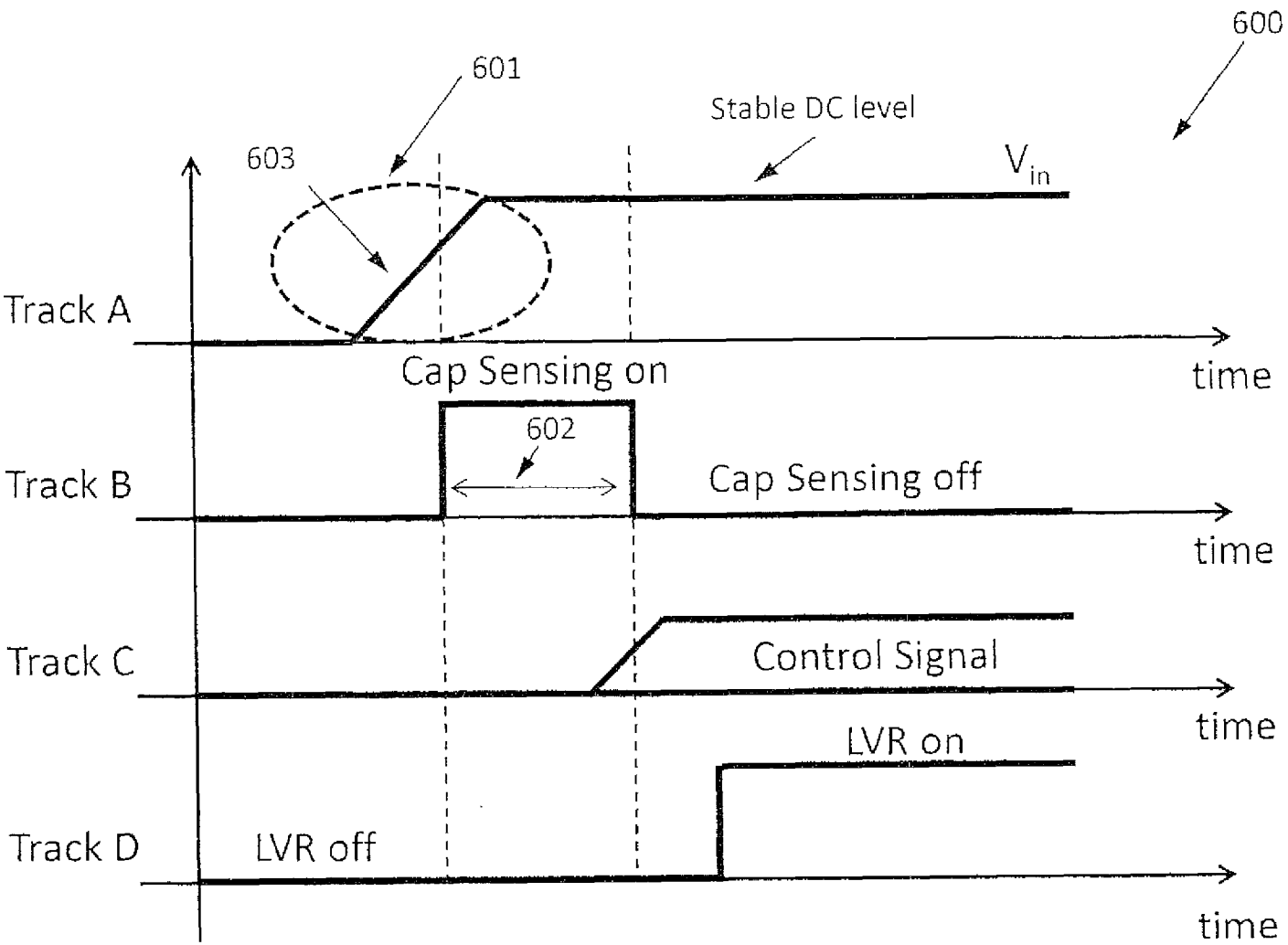
FIG. 6 shows the timing diagram to power on a capacitor-less LDO/load switch linear voltage regulator in accordance with embodiments of the invention.

FIG. 6 shows an example timing diagram (600) to illustrate the operation of the chip controller block (514), the capacitance sensing block (513), and the variable zero block (512) during the power on phase of the capacitor-less LDO linear voltage regulator (500) shown in FIG. 5A. As shown in FIG. 6, the timing diagram (600) includes track A through track D corresponding to the supply voltage input, the capacitance sensing on/off signal (514*b*), the control signal (513*a*), and the LVR on/off signal (514*a*), respectively, shown in FIG. 5A.

Specifically, track A shows $V_{in}$ (i.e., supply voltage input to the capacitor-less LDO linear voltage regulator (500)) ramping from zero volt to a stable DC level during the ramp-up time (601). Track B shows the cap sensing on/off signal (514*b*) generated by the chip control block (514) to define a capacitance sensing on window (602) starting from when $V_{in}$ reaches a reliable voltage level (603) at the input terminal "Supply" of the chip control block (514). During the capacitance sensing on window (602), the capacitance sensing on/off signal (514*b*) activates the capacitance sensing block (513) to perform load capacitance estimation. Track C shows the control signal (513*a*) generated by the capacitance sensing block (513) as the load capacitance estimation is completed. Specifically, the control signal (513*a*) controls the variable zero block (512) to adapt the aforementioned zero to the required frequency.

Track D shows the LVR on/off signal (514*a*) generated by the chip controller block (514) to keep the capacitor-less LDO linear voltage regulator (500) in an off state by turn off various active elements. As a result, the pass transistor $M_{pass}$ (507) is turned off during the capacitance sensing on window (602) and leaving the output voltage $V_{out}$ to be controlled by the capacitance sensing block (513). Subsequent to the completion of the load capacitance estimation, the capacitance sensing on/off signal (514*b*) turns off the capacitance sensing block (513) and the LVR on/off signal (514*a*) turns on the capacitor-less LDO/load switch linear voltage regulator (LVR). Although a specific timing sequence is shown in FIG. 6, different timing approach may also be used and the invention is not limited to embodiments shown in FIG. 6.

Figure 7:
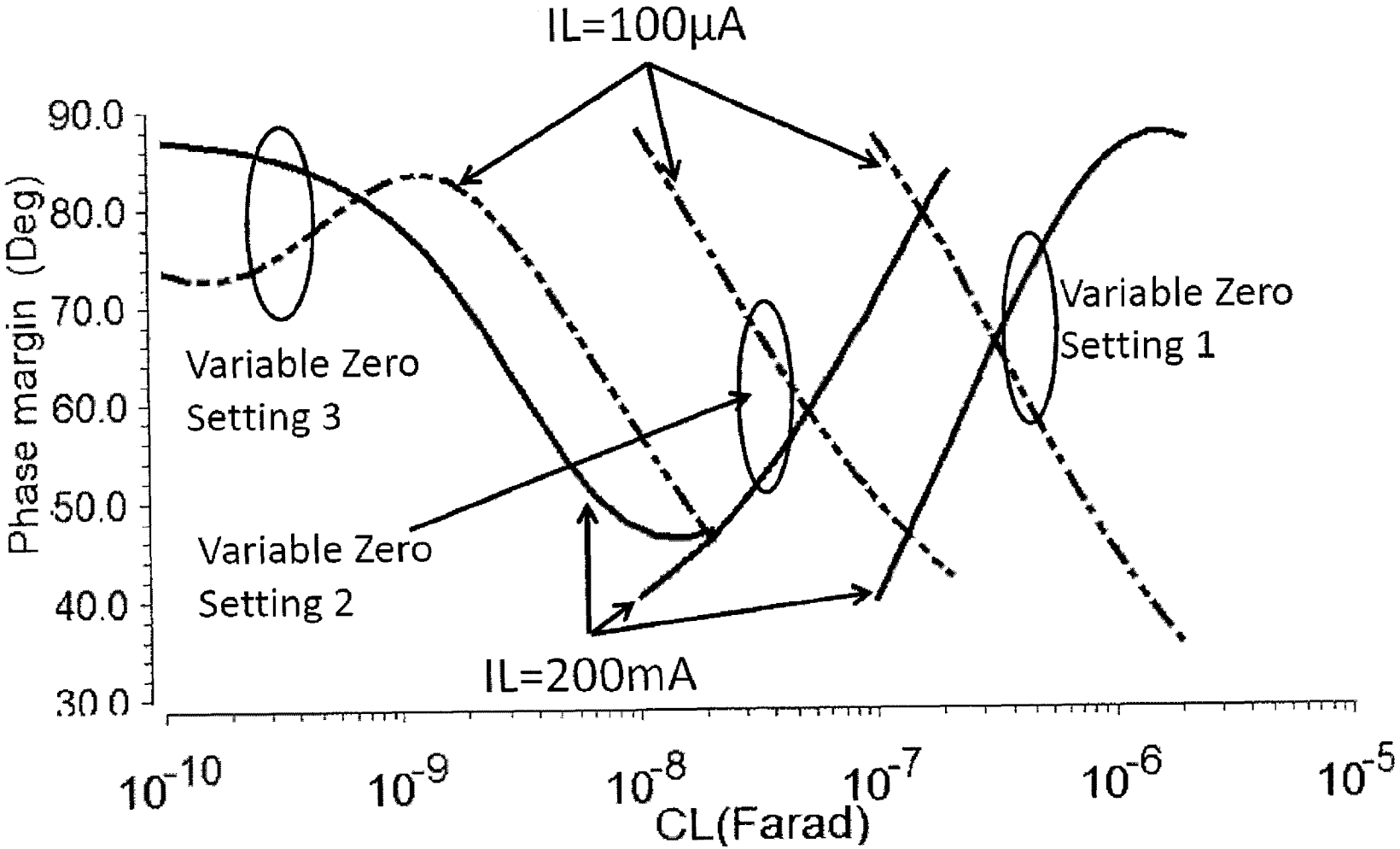
FIG. 7 shows example simulation results for phase margin under different load conditions of a LDO linear voltage regulator/load switch voltage regulator in accordance with embodiments of the invention.

FIG. 7 shows example simulation results for phase margin under different load conditions of the capacitor-less LDO linear voltage regulator (500) shown in FIG. 5A. Specifically, FIG. 7 shows phase margin simulation results of two load conditions 100 μA and 200 mA in combination with three variable zero settings. Variable zero setting 1, 2, and 3 are for load capacitances ranging from 100 nF to 2 μF, 10 nF to 200 nF, and 0 nF to 20 nF, respectively. The variable zero setting 1 forces the zero of the variable zero block (512) to be placed at a lower frequency. As the load capacitance is decreased, the variable zero settings 2 and 3 increase the frequency of the zero generated by the variable zero block (512). Based on these simulation results, the capacitance sensing technique to adapt the internal zero in the improved capacitor-less LDO (500) achieves a phase margin better than 45 degree over a load capacitance range up to 10 μF. This enables the improved capacitor-less LDO (500) to supply load current up to a value higher than 500 mA.

Figure 8A:
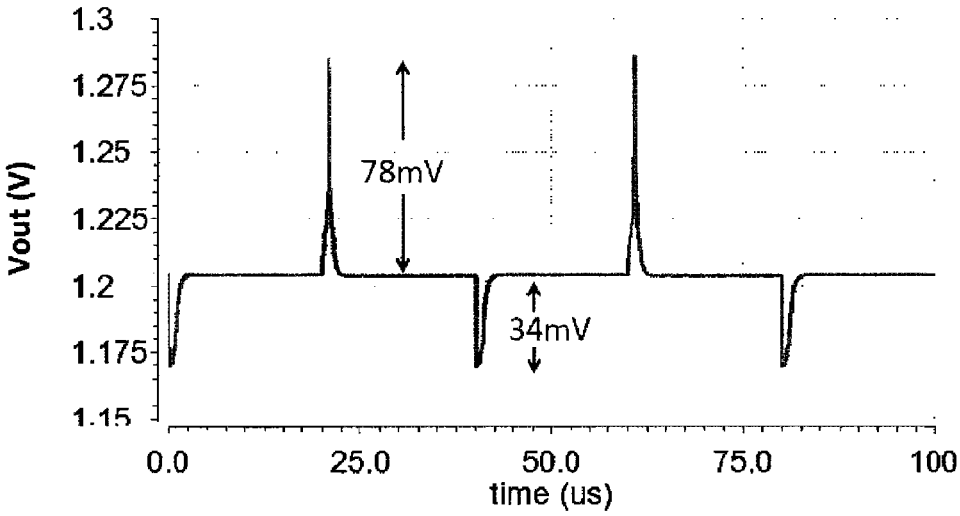
FIGS. 8A-8B show example simulation results for load transient regulation of a LDO linear voltage regulator/load switch voltage regulator in accordance with embodiments of the invention.
Figure 8B:
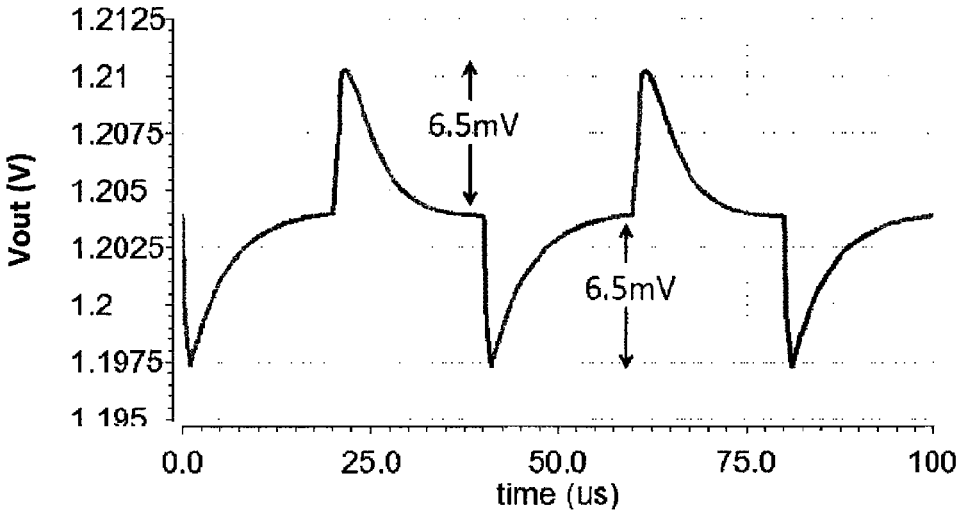

FIGS. 8A-8B show example simulation results for load transient regulation of the capacitor-less LDO linear voltage regulator (500) shown in FIG. 5A. Specifically, FIGS. 5A and 8B show example simulation results for load capacitances of 100 pF and 1 μF, respectively. These simulation results demonstrate that load transient regulation better than 80 mV is achieved when the load current changes from 1 mA to 200 mA in 1 μsec. In all the simulated examples, load capacitances up to 10 μF are supported by the improved capacitor-less LDO (500). In contrast, prior art capacitor-less LDO architectures cannot support this wide range of load capacitances, and the reported load transient regulation is worse than 1 V for the same test conditions used in the simulated example. On the other hand, LDOs that require an external capacitor achieve similar load transient regulation but cannot support load capacitances ranging from 0 to 10 μF.

In one or more embodiments, a supply rejection circuit (i.e., supply rejection blocks (303), (403), and (503) shown in FIGS. 3, 4, and 5A above) is used as an additional supply noise rejection circuit that injects a scaled version of the supply ripples at the gate of the pass transistor device (i.e., $M_{pass}$) in FIGS. 3, 4, and 5A to cancel out the effects of input ripples in $V_{in}$, on the output voltage $V_{out}$. Hence, a higher PSR is achieved for DC operation. The input ripples are any supply noise appearing at the input terminal ($V_{in}$) of the LDO (100) of FIG. 1, LDO (300) of FIG. 3 or LDO (500) of FIG. 5A. Those skilled in the art, with the benefit of this disclosure will appreciate that other circuit configurations may also be used to replicate supply noise for injecting to a particular circuit node in the LDO.

Figure 9:
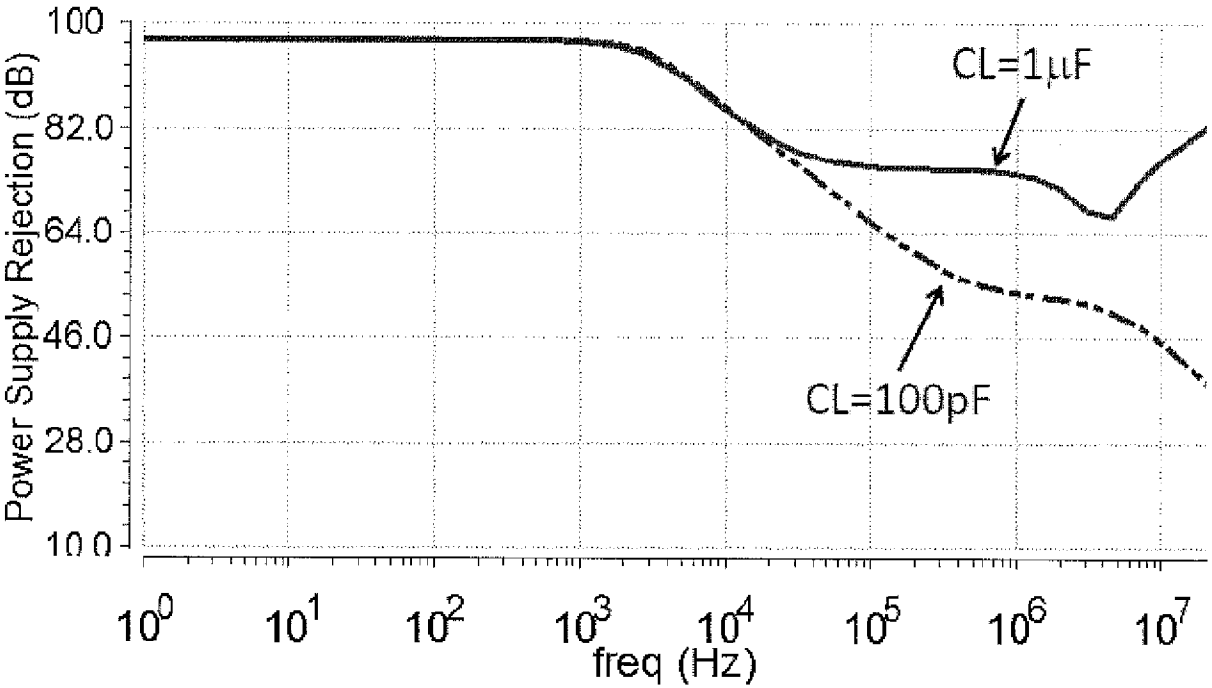
FIG. 9 shows example simulation results for power supply rejection of a LDO linear voltage regulator in accordance with embodiments of the invention.

Simulations have shown that the LDOs (300) and (500), depicted in FIGS. 3 and 5A above, may achieve PSR of 50 and 35 dB at 1 MHz and 10 MHz, respectively without the supply rejection block. The PSR is enhanced by at least 15 dB across a wide frequency range when the supply rejection block is introduced. FIG. 9 shows the PSR simulation results at DC, 1 MHz and 10 MHz for the LDOs (300) and (500). As shown, a PSR better than 70 dB is achieved up to a frequency of 1 MHz, and better than 45 dB up to 10 MHz for a wide range of load conditions. This simulation is done for a load capacitance of 100 pF and load currents up to 200 mA. The simulation circuit parameters include an open loop gain higher than 70 dB, an amplifier offset better than 5 mV, and the value of $C_m$ is 200 pF. In contrast, simulations show that prior art capacitor-less LDOs (e.g., shown in FIG. 2) typically achieve only 40 dB and 0 dB of PSR at 1 MHz and 10 MHz, respectively.

While the invention has been described for a low drop-out regulator, the same technique and circuit configuration are equally applicable for a load switch. The load switch can be seen as a two terminal device in which one terminal is the input supply and the other terminal is the output voltage. The output DC voltage changes with the input DC voltage proportionally. This load switch filters the high frequency supply noise without propagating it to the output. Similar to the capacitor-less LDO, there is also a capacitor-less load switch.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for adjusting stability of a low drop-out (LDO)/load switch linear voltage regulator (LVR) having an open loop transfer function, comprising:

determining, during a power-up phase and by a capacitance sensing circuit, an estimated output capacitance value at an output node of the LDO/load switch LVR; and adjusting, based on the estimated output capacitance value, an adaptive RC network in the LDO/load switch LVR, wherein the adaptive RC network produces an adaptive zero in a feedback network transfer function of the LDO/load switch LVR, and wherein the adaptive zero reduces an effect of a non-dominant pole of the open loop transfer function of the LDO/load switch LVR, maintaining the LDO/load switch LVR in an off state while the estimated output capacitance value is being determined and while the adaptive RC network is being adjusted; and wherein adjusting the adaptive RC network determines a frequency of the adaptive zero to reduce phase margin degradation due to the non-dominant pole of the open loop transfer function of the LDO/load switch LVR, and wherein the LDO/load switch LVR remains stable over a plurality of capacitive load conditions ranging from no capacitive load to a 10 μF load.

2. A low drop-out (LDO)/load switch linear voltage regulator (LVR) circuit having an open loop transfer function, comprising:

a feedback network comprising:

a first input coupled to an output of the LVR circuit;

a second input coupled to a reference voltage;

a third input coupled to a capacitance sensing circuit block; and an output driving a gate terminal of a pass transistor;

the capacitance sensing circuit block comprising:

an input coupled to the output of the LVR circuit; and an output coupled to the third input of the feedback network; and the pass transistor comprising:

the gate terminal driven by the output of the feedback network;

a first terminal coupled to an input of the LVR circuit; and a second terminal coupled to the output of the LVR circuit, wherein the feedback network is configured to regulate an output voltage level of the output of the LVR circuit based on the reference voltage, wherein the pass transistor comprises at least one selected from a group consisting of an n-type field effect transistor, a p-type field effect transistor, and a bipolar junction transistor, wherein the capacitance sensing circuit block is configured to:

estimate a load capacitance at the output of the LVR circuit; and generate a control signal to adjust at least one circuit parameter of the feedback network to prevent any oscillation at the output of the LVR circuit over a plurality of pre-determined load conditions, wherein the LVR circuit remains stable over a plurality of capacitive load conditions ranging from no capacitive load to a 10 uF load, wherein a dominant pole of the open loop transfer function of the LVR circuit is at the output of the LVR circuit over a pre-determined frequency range and the plurality of pre-determined load conditions, wherein the feedback network further comprises a resistive divider, an error amplifier, a first buffer, a second buffer, and a capacitor, wherein the first buffer comprises:

an input coupled to an output of the error amplifier and an input of the second buffer; and an output coupled to a first terminal of the capacitor, wherein the error amplifier comprises:

a first input for receiving the reference voltage; and a second input coupled to an output of the resistive divider, wherein the resistive divider comprises:

an input connected to the output of the LVR circuit; and an output connected to the second input of the error amplifier, wherein the capacitor comprises:

a first terminal connected the output of the first buffer; and a second terminal connected to the output of the LVR circuit, wherein a second buffer comprises an output driving the gate terminal of the pass transistor, and wherein the resistive divider scales down the output voltage level of the LVR circuit.

3. The low drop-out (LDO)/load switch linear voltage regulator (LVR) circuit of claim 2, wherein the first buffer is configured to:

isolate the output of the error amplifier from being affected by load current variations of the LVR circuit; and add a zero to the open loop transfer function of the LVR circuit to reduce an effect of a non-dominant pole of the open loop transfer function of the LVR circuit.

4. The low drop-out (LDO)/load switch linear voltage regulator (LVR) circuit of claim 3, wherein the second buffer is configured to increase a gain of the feedback network and driving the pass transistor.

5. The low drop-out (LDO)/load switch linear voltage regulator (LVR) circuit of claim 2, further comprising:

a zero generation circuit configured to generate a zero, wherein the input of the first buffer is coupled to the output of the error amplifier and the input of the second buffer via the zero generation circuit.

6. The low drop-out (LDO)/load switch linear voltage regulator (LVR) circuit of claim 5, wherein the zero generation circuit comprises an adaptive RC network forming a low pass filter, and wherein a time constant of the adaptive RC network is controlled by the capacitance sensing circuit block based on the estimated load capacitance.

7. The low drop-out (LDO)/load switch linear voltage regulator (LVR) circuit of claim 6, wherein the adaptive RC network comprises at least one selected from a group consisting of a variable capacitor and a variable resistor controlled by the capacitance sensing circuit block based on the estimated load capacitance.

8. The low drop-out (LDO)/load switch linear voltage regulator (LVR) circuit of claim 5, further comprising:

a supply rejection circuit configured to inject a scaled version of input ripples into the LVR circuit to reduce an effect of the input ripples.

9. The low drop-out (LDO)/load switch linear voltage regulator (LVR) circuit of claim 2, wherein the LVR circuit is at least one selected from a group consisting of a capacitor-less low drop-out LVR and a capacitor-less load switch LVR.

10. The low drop-out (LDO)/load switch linear voltage regulator (LVR) circuit of claim 2, further comprising:

a capacitance estimating circuit configured to estimate the output load capacitance at the output of the LVR circuit, wherein the feedback network is adjusted based on the estimated output load capacitance.

11. A low drop-out (LDO)/load switch linear voltage regulator (LVR) circuit having an open loop transfer function, comprising:

a feedback network comprising:

a first input coupled to an output of the LVR circuit, a second input coupled to a reference voltage, a third input coupled to a capacitance sensing circuit block, and an output driving a gate terminal of a pass transistor;

the capacitance sensing circuit block comprising:

an input coupled to the output of the LVR circuit, and an output coupled to the third input of the feedback network; and the pass transistor comprising:

the gate terminal driven by the output of the feedback network, a first terminal coupled to an input of the LVR circuit, and a second terminal coupled to the output of the LVR circuit, wherein the feedback network is configured to regulate an output voltage level of the output of the LVR circuit based on the reference voltage, wherein the pass transistor comprises at least one selected from a group consisting of an n-type field effect transistor, a p-type field effect transistor, and a bipolar junction transistor, wherein the capacitance sensing circuit block is configured to:

estimate a load capacitance at the output of the LVR circuit, and generate a control signal to adjust at least one circuit parameter of the feedback network to prevent any oscillation at the output of the LVR circuit over a plurality of pre-determined load conditions, a current source comprising:

a first terminal coupled to the output of the LVR circuit; and a second terminal coupled to a fixed voltage;

a comparator comprising:

a first input coupled to the output of the LVR circuit; and a second input coupled to a constant voltage; and a counter configured to generate a count proportional to a time period for the current source to charge the load capacitance for the output of the LVR circuit to reach the constant voltage.

12. The low drop-out (LDO)/load switch linear voltage regulator (LVR) circuit of claim 11, further comprising a chip controller configured to:

activate the capacitance sensing circuit block during a power up phase of the LVR circuit; and de-activate the capacitance sensing circuit block subsequent to the power up phase of the LVR circuit.

13. The low drop-out (LDO)/load switch linear voltage regulator (LVR) circuit of claim 11, where the count represents the estimated load capacitance.

* * * * *